United States Patent [19]

Bortak

[11] 3,960,698

[45] June 1, 1976

[54] ELECTRODE SUPPORT FOR FILTER PRESS CELLS

[75] Inventor: John J. Bortak, Plymouth, Mich.

[73] Assignee: BASF Wyandotte Corporation, Wyandotte, Mich.

[22] Filed: Dec. 23, 1974

[21] Appl. No.: 535,939

[52] U.S. Cl. ..... 204/267; 204/254; 204/255; 204/256; 204/279; 204/286; 204/297 R

[51] Int. Cl.[2] ..... B01K 1/00; C25B 9/02

[58] Field of Search ..... 204/254, 255, 256, 268, 204/279, 286, 267, 283, 297 R

[56] References Cited

UNITED STATES PATENTS

| | | | |
|---|---|---|---|
| 1,153,168 | 9/1915 | Levin | 204/256 |
| 1,366,404 | 1/1921 | MacDougall | 204/283 |
| 2,735,812 | 2/1956 | Van Hoek | 204/279 X |
| 3,247,090 | 4/1966 | Forbes | 204/254 X |
| 3,824,173 | 7/1974 | Bouy et al. | 204/268 X |

*Primary Examiner*—G. L. Kaplan
*Assistant Examiner*—A. C. Prescott
*Attorney, Agent, or Firm*—Bernhard R. Swick; Arnold S. Weintraub; Robert E. Dunn

[57] ABSTRACT

The central web of a bipolar electrolytic filter press cell has a plurality of nubs projecting therefrom to support the electrode and to maintain their flatness.

3 Claims, 2 Drawing Figures

ELECTRODE SUPPORT FOR FILTER PRESS CELLS

BACKGROUND OF THE INVENTION

1. Field of the Invention

The present invention pertains to electrolytic filter press cells. More particularly, the present invention pertains to bipolar electrolytic filter press cells and means for supporting the electrodes thereof.

2. Prior Art

In an electrolytic filter press cell it is critical to the efficient operation thereof that the electrode flatness and spacing be maintained. If the electrodes are too far apart, then an excessive voltage is obtained. If the electrodes are spaced too close together, flow restrictions, as with a diaphragm cell, potential puncturing of the membrane or diaphragm and high voltage can occur.

If the electrode flatness is not maintained, then voltage differentials can occur thereacross, again, disrupting the cell performance. The occurrence of electrode warping or bowing is most often encountered with large electrodes.

The present invention provides means for maintaining the proper spacing between electrodes while concurrently providing means for maintaining electrode flatness.

SUMMARY OF THE INVENTION

In accordance with the present invention a plurality of nubs or projections are provided on the central web of an electrolytic filter press cell. The projections extend a predetermined distance to abut a first surface of an electrode.

By abutting the electrode surface the projections support the electrode while maintaining the proper or optimal spacing thereof. Furthermore, the electrode can be secured to the nubs, by any suitable means, to ensure that the electrode remains flat.

The present invention is particularly adapted for use in bipolar electrolytic filter press cells, and, in particular, bipolar electrolytic filter press cells for the production of chlorine and caustic.

For a more complete understanding of the present invention reference is made to the following detailed description and accompanying drawing. In the drawing, like reference characters refer to like parts throughout the several views, in which:

DESCRIPTION OF THE PREFERRED EMBODIMENT

Figure 1:
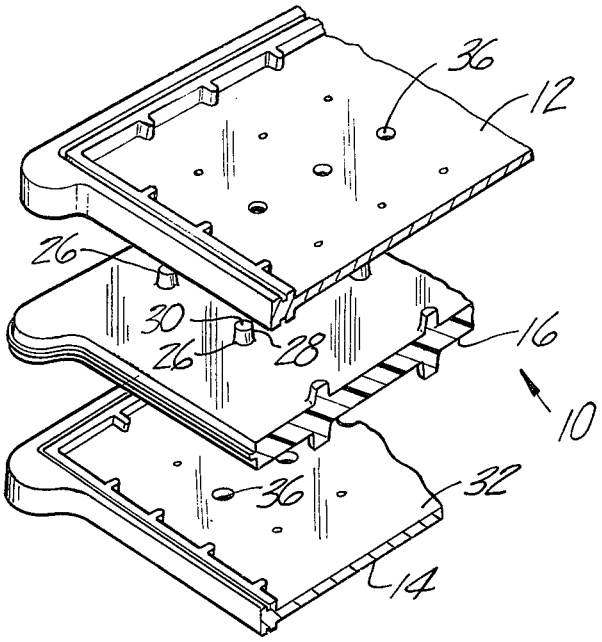
FIG. 1 is a fragmented exploded perspective view of an electrode assembly of a filter press cell in accordance with the present invention.
Figure 2:
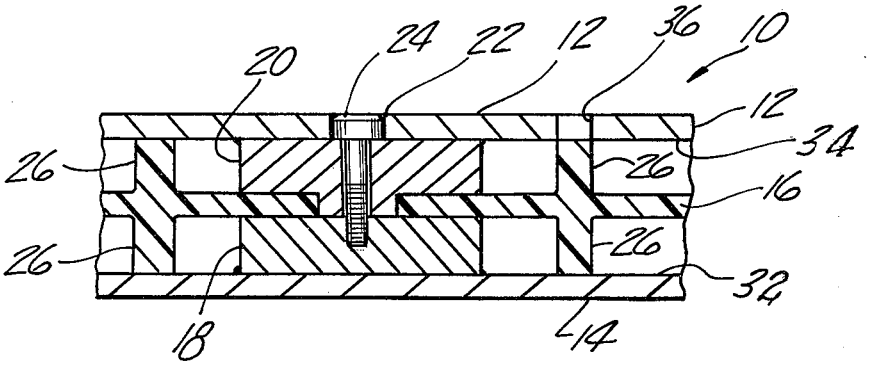
FIG. 2 is a fragmented cross-sectional view of a bipolar electrolytic filter press cell taken about the bolt joining the anode and cathode together.

Now with reference to the drawing there is depicted an electrolytic filter press cell 10. The filter press cell, generally, includes a first electrode 12 spaced apart from a second electrode 14.

Interposed between the first and second electrodes 12, 14 is a central web or barrier 16. As is known to those skilled in the art, the central web or barrier 16 is, actually, interposed between adjacent cells. Thus, the assembly depicted in the drawing, shows an anode 14, a central web 16 and a metal electrode 12 of an adjacent cell.

In the assembly shown in the drawing, each electrode has associated therewith a boss 18, 20, respectively. A central threaded bore 22 extends through the bosses 18, 20, as shown. A bolt 24 is threadingly received in the bore 22. The bolt 24 provides both the electrical and mechanical connection between the adjacent cells.

The construction of the bosses and the interconnection between the adjacent cells is more particularly described in U.S. Pat. No. 3,752,757, the disclosure of which is hereby incorporated by reference. In this regard, it should be noted that the central barrier 16 is, preferably, formed from a plastic material to define a barrier to prevent the flow of gasses and liquid from one cell to another.

Referring again to the drawing, the central web 16 is provided with a plurality of nubs or projections 26. The nubs 26 are integrally formed with or otherwise secured to the barrier 16. As shown, the nubs are formed substantially perpendicular to the barrier. Although the nubs 26 are shown as being conical it is not essential hereto that this configuration be maintained. Rather, any configuration can be utilized so long as the free ends 28 of the nubs 26 have a flat surface 30, but the conical configuration is preferred.

The nubs 26 have a predetermined length as a function of cell design. The predetermined length is designed to provide optimum cell performance with respect to electrode spacing and the like.

As shown in the drawing, the flat surface 30 abuts and engages a first electrode surface 33, 34 respectively. In this manner the nubs define support means for supporting the electrodes.

The nubs 26 are preferably formed from the same plastic material as the central web. This permits the nubs to be formed contemporaneously with the barrier in a single molding operation.

By providing suitable apertures 36 in the electrode 12 or 14 the nubs 26 can, also, function as means for properly positioning the electrode in the filter press cell. In such instance, the electrode is mounted on the nubs 26. However, such construction is optional.

In accordance with the present invention, the nubs 26, also, define means for maintaining the flatness of the electrode. When the electrodes are positioned within the cell they are secured to the nubs by any suitable means, such as rivets, screws, tacks, spot welds or the like. By securing the electrodes to the nubs bowing of the electrode frame is obviated.

Although the present invention is efficaciously employed in any electrolytic cell, it is eminently useful in bipolar electrolytic filter press cells for the production of caustic and chlorine.

Having, thus, described the invention, what is claimed is:

1. In an electrolytic filter press cell of the type having a central barrier between the electrodes of adjacent cells, the improvement which comprises:

means for supporting the electrodes formed on the central barrier wherein said means for supporting the electrodes comprises a plurality of solid projections formed on the central barrier and wherein the projections abut and engage the electrodes on a first surface thereof.

2. The improvement of claim 1 wherein the electrodes are secured to the projections such that the projections define means for maintaining the flatness of the electrodes.

3. The improvement of claim 1 wherein the projections are integrally formed with the central barrier.

* * * * *